US005381677A

United States Patent [19]

Park et al.

[11] Patent Number: 5,381,677

[45] Date of Patent: Jan. 17, 1995

[54] AUTOMATIC WASHING MACHINE

[75] Inventors: Gwan R. Park, Seoul; Jae C. Lyu, Kyungki, both of Rep. of Korea

[73] Assignee: Goldstar Co., Ltd., Seoul, Rep. of Korea

[21] Appl. No.: 165,883

[22] Filed: Dec. 14, 1993

[30] Foreign Application Priority Data

Mar. 31, 1993 [KR] Rep. of Korea ..... 5290/1993

[51] Int. Cl.[6] ..... D06F 13/02

[52] U.S. Cl. ..... 68/23.7; 68/133

[58] Field of Search ..... 68/23.6, 23.7, 132, 68/133, 134

[56] References Cited

U.S. PATENT DOCUMENTS

| | | | |
|---|---|---|---|
| 3,481,161 | 12/1969 | Wasemann | 68/23.6 |
| 4,813,248 | 3/1989 | Smith et al. | 68/23.7 |
| 4,837,882 | 6/1989 | Brenner et al. | 68/23.7 |
| 5,150,589 | 9/1992 | Williams et al. | 68/23.7 |
| 5,208,931 | 5/1993 | Williams et al. | 68/23.7 |

*Primary Examiner*—Frankie L. Stinson
*Attorney, Agent, or Firm*—Fish & Richardson

[57] ABSTRACT

An automatic washing machine having a floating member for selectively engaging the inner tub with the rotator or with the outer tub. The outer tub has first teeth on its inner bottom and the inner tub has a through hole on its bottom, and the rotator has second teeth on its lower surface. The drive motor is mounted on the outer bottom center of the outer tub and its output shaft rotatably penetrates the bottom centers of the tubs. The lever having the floating member and a moving tooth on its opposed ends is hinged to a housing between bottoms of the tubs. The selective engagement of the inner tub with the rotator or with the outer tub is achieved by selective engagement of the moving tooth with the second teeth or with the first teeth in accordance with a fluctuating movement of the floating member caused by buoyancy of the washing water in the outer tub. The rotator driving shaft and the motor may be eccentrically mounted on the outer bottom of the outer tub and, in this case, the rotational force is transmitted to the shaft by a transmission belt. The washing machine of this invention thus automatically converts its mode between the washing mode and the dehydrating mode.

17 Claims, 5 Drawing Sheets

AUTOMATIC WASHING MACHINE

BACKGROUND OF THE INVENTION

The present invention relates in general to an automatic washing machine, and more particularly to an automatic washing machine capable of selective power transmission from a drive motor to a washing and dehydrating tub in order to automatically convert its mode between the washing mode and the dehydrating mode.

As well known to those skilled in the art, a conventional automatic washing machine includes a drive motor and a clutch which are placed at the outside of the lower section of an outer tub and connected to each other by a transmission V-belt. The washing machine also includes a washing shaft and a dehydrating shaft either of which is applied with the rotational force of the drive motor under the clutching operation of the clutch to be rotated, thus to achieve a desired washing operation or a desired dehydrating operation.

With reference to FIG. 1, there is shown in a schematic view an example of the conventional automatic washing machine. The washing machine includes an inner tub 22 which is placed in an outer tub 21 such that it is rotated by the rotational force of a drive motor 23.

Here, the drive motor 23 is placed at the outside of the lower section of the outer tub 21 and connected to a clutch assembly 26 by a transmission V-belt 24, which is wrapped about a motor pulley and a clutch pulley, as described above.

The automatic washing machine further includes two types of shafts, that is, a dehydrating shaft, which comprises upper and lower dehydrating shafts 29 and 31, and a washing shaft 37. The dehydrating shaft 29 and 31 and the washing shaft 37 coaxially extend from the clutch assembly 26 and are coupled to the inner tube 22 and a rotator 25, respectively. Here, the rotator 25 will be a pulsator or an agitator in accordance with the type of the washing machine.

FIG. 2 is an enlarged sectional view showing a construction of the clutch assembly 26. In this clutch assembly 26, a spring block 28 is fixed to a lower section of a gear shaft 27 and directly applied with the rotational force of the drive motor 23 through the V-belt 24.

A clutch spring 32 is mounted about the lower dehydrating shaft 31 which is integrally formed with both the upper dehydrating shaft 29 and a brake drum and gear housing 30. This clutch spring 32 controls the rotational force of the drive motor 23 transmitted to the clutch assembly 26 during the washing operation of the washing machine.

In order to apply a predetermined pressure to the outer surface of the brake drum and gear housing 30, a brake band 39 is wrapped about the brake drum and gear housing 30.

The clutch assembly 26 also includes a clutch boss 33 which is provided with teeth 33*a* at its circumferential surface and coupled to the outer surface of the clutch spring 32. In addition, a clutch boss cam 35 is rotatably mounted on a lower end of a brake lever 34.

The brake lever 34 is placed at a predetermined position where it is engaged with the teeth 33*a* of the clutch boss 33 and cooperates with a drain valve operating solenoid (not shown) which is mounted on a side of the outer tub 21.

In order to prevent reverse rotation of the inner tub 22, the clutch assembly 26 includes an one way spring clutch 36.

A planet gear 38 is provided in the clutch assembly 26 for reduction of the rotational force of the gear shaft 27 prior to transmission of this rotational force to the washing shaft 37.

In the case of the washing mode of this conventional automatic washing machine, the clutch is in a non-clutched state, so that only the rotator 25 is alternately rotated in opposed directions while the inner tub 22 is stopped. However, in the case of the dehydrating mode of the washing machine, the clutch is in a clutched state, so that the rotator 25 and the inner tub 22 are simultaneously rotated at the same high rotational speed.

Hereinbelow, the operations of the conventional washing machine in the washing mode and of the dehydrating mode will be described in detail.

In the washing mode of the washing machine, the forward rotational force of the drive motor 23 is transmitted to the clutch assembly 26 through the V-belt 24 wrapped about the clutch pulley. In this case, the clutch pulley is rotated in the forward direction and this forward rotation of the pulley tightens the clutch spring 32, thus to transmit the rotational force of the drive motor 23 to the lower dehydrating shaft 31 through the spring block 28.

However, the teeth 33*a* of the clutch boss 33 on the outer surface of the clutch spring 32 push the clutch boss cam 35 and prevent tightening of the clutch spring 32, thereby causing no rotational force of the motor 23 to be transmitted to the upper dehydrating shaft 29.

At this time, the rotational force of the motor 23 transmitted to the gear shaft 27 is reduced by the planet gear 38 and, thereafter, transmitted only to the washing shaft 34.

Only the rotator 25 coupled to the washing shaft 37 is thus rotated in order to achieve the desired washing operation.

Meanwhile, the reverse rotational force of the drive motor 23 in the washing mode is transmitted to the clutch assembly 26 through the V-belt 24 in the same manner as described for the above forward rotational force. In this case, the clutch pulley is rotated in the reverse direction and this loosens the clutch spring 32, causing the rotational force of the gear shaft 27 not to be transmitted to the dehydrating shaft 29 but to washing shaft 37 through the planet gear 38. At this time, the rotational force is reduced by the planet gear 38 prior to its transmission to the washing shaft 37.

When the rotational force of the gear shaft 27 is reduced by the planet gear 38, there is generated a reaction torque in the gear housing 30, so that the upper dehydrating shaft 29 may be rotated in reverse direction.

However, this reverse rotation of the dehydrating shaft 29 is reliably prevented by both the one way spring clutch 36 and the brake band 39 wrapped about the brake drum and gear housing 30.

In the dehydrating mode of the washing machine, the forward rotational force of the drive motor 23 is transmitted to the clutch assembly 26 through the V-belt 24 wrapped about the clutch pulley. In this case, the clutch pulley is rotated in the forward direction and this forward rotation of the pulley tightens the clutch spring 32, thus to turn on the drain valve operating solenoid (not shown) and to pull a lever 40.

The clutch spring 32 thus comes into close contact with the spring block 28, and the clutch boss cam 35 of the brake lever 34 cooperating with the lever 40 is separated from the teeth 33*a* of the clutch boss 33 and, at the same time, the brake band 39 is released from the outer surface of the gear housing 30. Therefore, the rotational force of the spring block 28 is transmitted to the lower dehydrating shaft 31 of the gear housing 30 and rotates the upper dehydrating shaft 29, integrally formed with the gear housing 30, at a high speed without speed reduction. The inner tub 22 and the rotator 25, which are coupled to the dehydrating shaft 29 and the washing shaft 37 respectively, are thus rotated at high speed, thereby achieving the desired dehydrating operation.

When the desired dehydration is finished or the dehydration mode of the washing machine is canceled, the drain valve operating solenoid is turned off.

Upon turning off the drain valve operating solenoid, the pulled lever 40 is released from its pulled state, and the clutch boss cam 25 is engaged with the teeth 33*a* of the clutch boss 33 and, at the same time, the brake band 39 is tightened on the outer surface of the gear housing 30, thus causing the washing machine to be converted in its mode into the washing mode. The rotation of the brake drum and gear housing 30 is thus stopped.

Accordingly, the inner tub 22 coupled to the dehydrating shaft 29 and to the gear housing 30 is stopped in order to end the operation of the washing machine.

As described above, the conventional automatic washing machine should have a complex clutch for selective transmission of the rotational force of the drive motor to the inner tub in accordance with the operational mode of the washing machine. Hence, the manufacturing cost of the washing machine is increased. In addition, the provision of the clutch assembly causes a power loss in selective transmission of the rotational force of the drive motor to the washing shaft or to the dehydrating shaft under the control of the clutch assembly.

SUMMARY OF THE INVENTION

It is, therefore, an object of the present invention to provide an automatic washing machine in which the aforementioned problem can be overcome and which has a floating member between an inner tub and an outer tub, and selectively engages the inner tub with a rotator or with the outer tub according to a fluctuating movement of the floating member caused by buoyancy of washing water in the outer tub, thus to automatically converting its mode between the washing mode and the dehydrating mode.

In order to accomplish the above object, an automatic washing machine in accordance with an embodiment of the present invention comprises an outer tub for containing washing water therein, the outer tub having first teeth on its inner bottom; an inner tub for washing and dehydration placed in the outer tub, the inner tub having a plurality of perforations on its side wall and a through hole on its bottom at a position corresponding to the first teeth of the outer tub; a motor mounted on an outer bottom center of the outer tub, the motor having an output shaft rotatably penetrating bottom centers of the outer and inner tubs; means for generating a water current using the rotational force of the motor, the water current generating means being mounted on a top end of the output shaft and having second teeth on its lower surface at a position corresponding to the through hole of the inner tub; and means for selectively engaging the inner tub with the water current generating means or with the outer tub, the selective engaging means being mounted between bottoms of the inner and outer tubs and having a floating member, the selective engagement of the inner tub with the water current generating means or with the outer tub being achieved in accordance with a fluctuating movement of the floating member caused by buoyancy of the washing water in the outer tub.

In accordance with another embodiment of this invention, the shaft rotatably penetrates the bottom centers of the outer and inner tubs and the drive motor is mounted on the outer bottom of the outer tub such that it is eccentric from the shaft. In this case, means for transmitting a rotational force of the motor to the shaft is additionally provided.

Objects and advantages of the invention will become apparent from the following description of embodiments with reference to the accompanying drawings.

BRIEF DESCRIPTION OF THE DRAWINGS

FIGS. 4*a* and 4*b* are partially enlarged sectional views of the washing machine of FIG. 3, respectively, in which:

FIG. 4*a* shows the washing machine in a washing mode;

FIG. 4*b* shows the washing machine in a dehydrating mode; and

DESCRIPTION OF THE PREFERRED EMBODIMENTS

Figure 1:
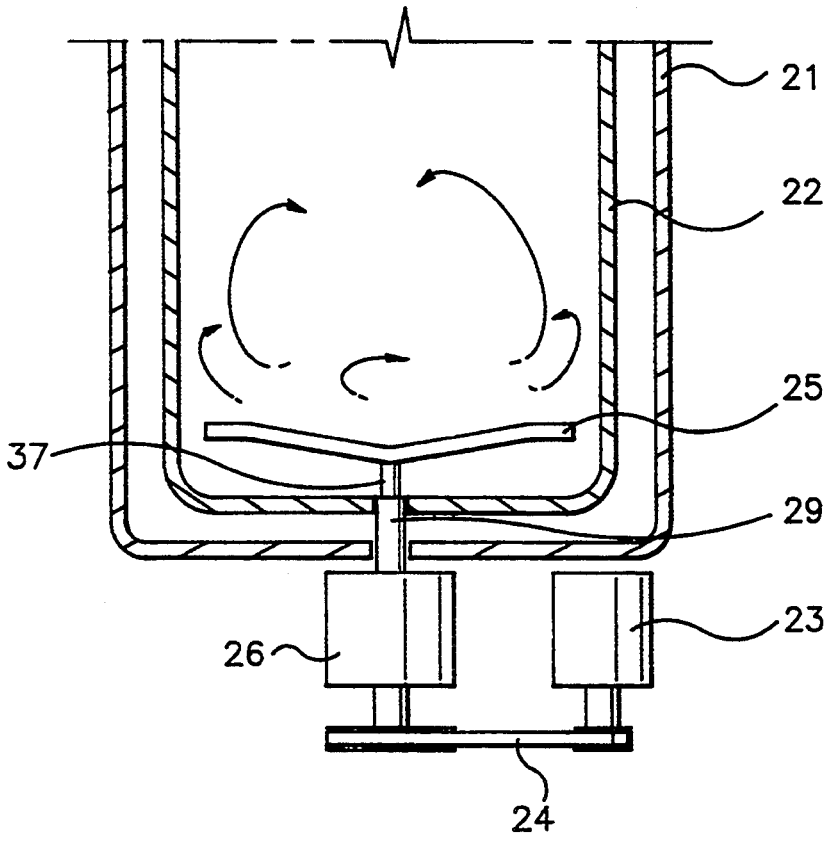
FIG. 1 is a schematic view of a conventional automatic washing machine.
Figure 2:
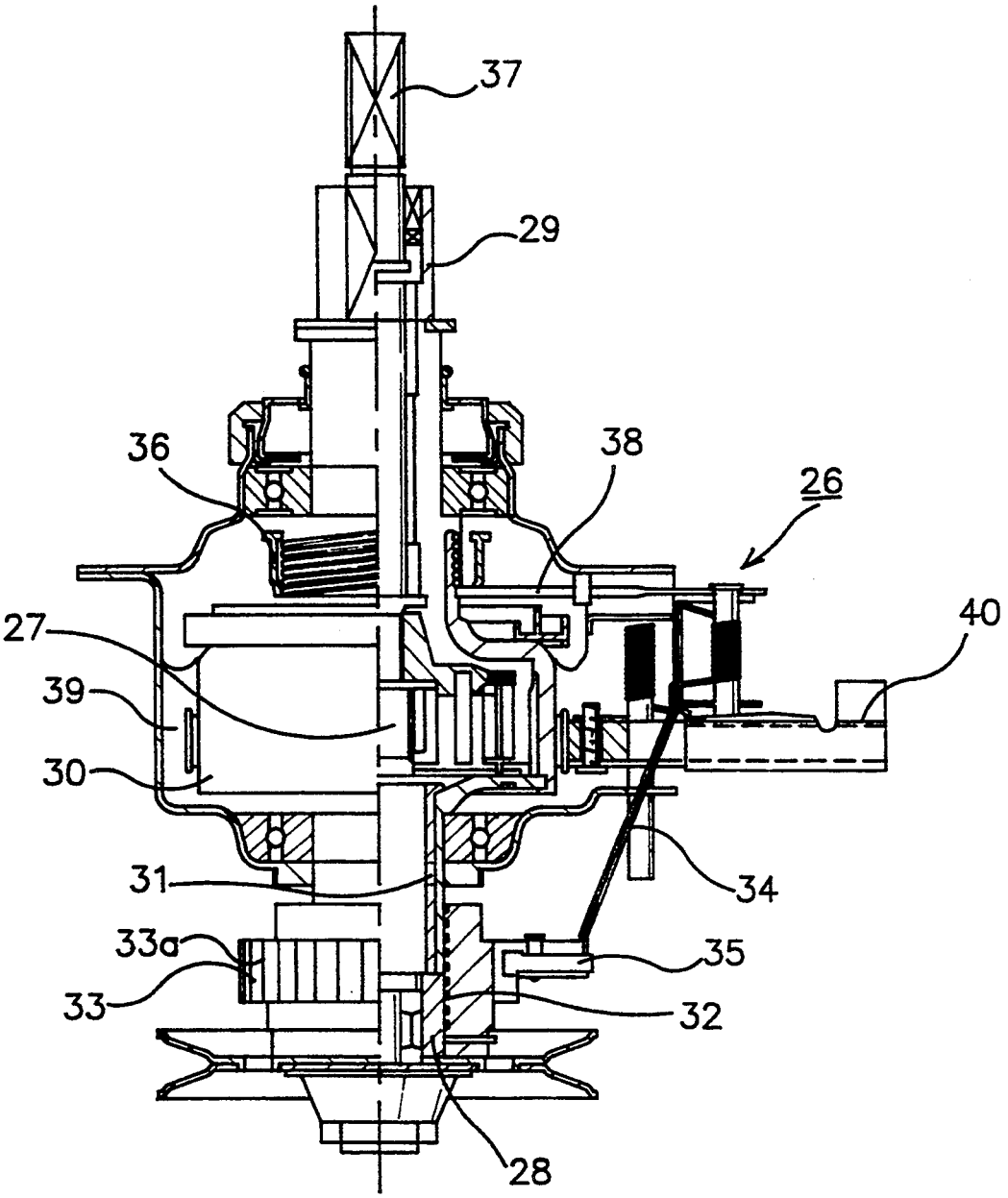
FIG. 2 is an enlarged sectional view showing a construction of a clutch assembly of the washing machine of FIG. 1.
Figure 3:
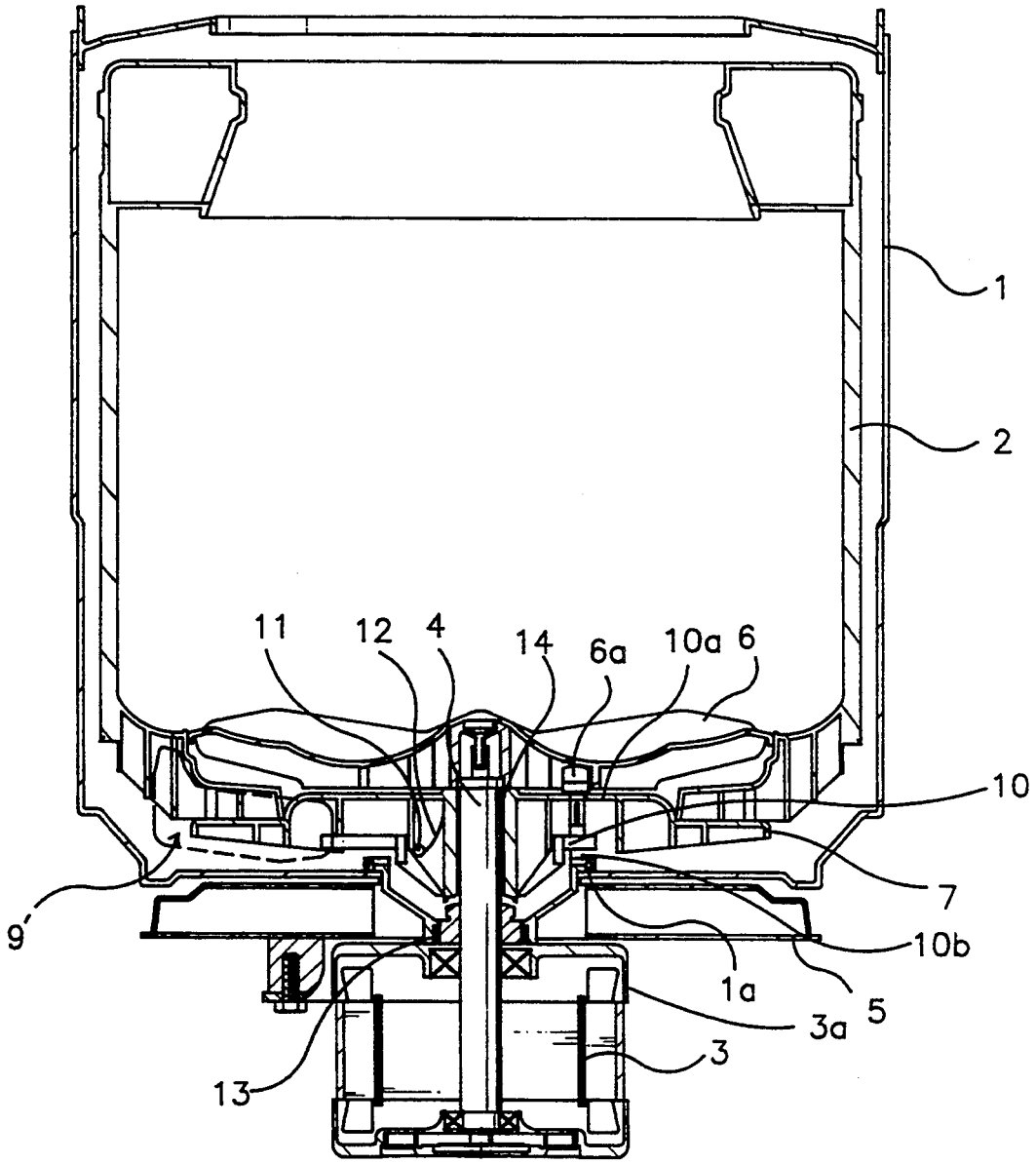
FIG. 3 is a schematic sectional view of an automatic washing machine in accordance with a primary embodiment of the present invention.
Figure 4A:
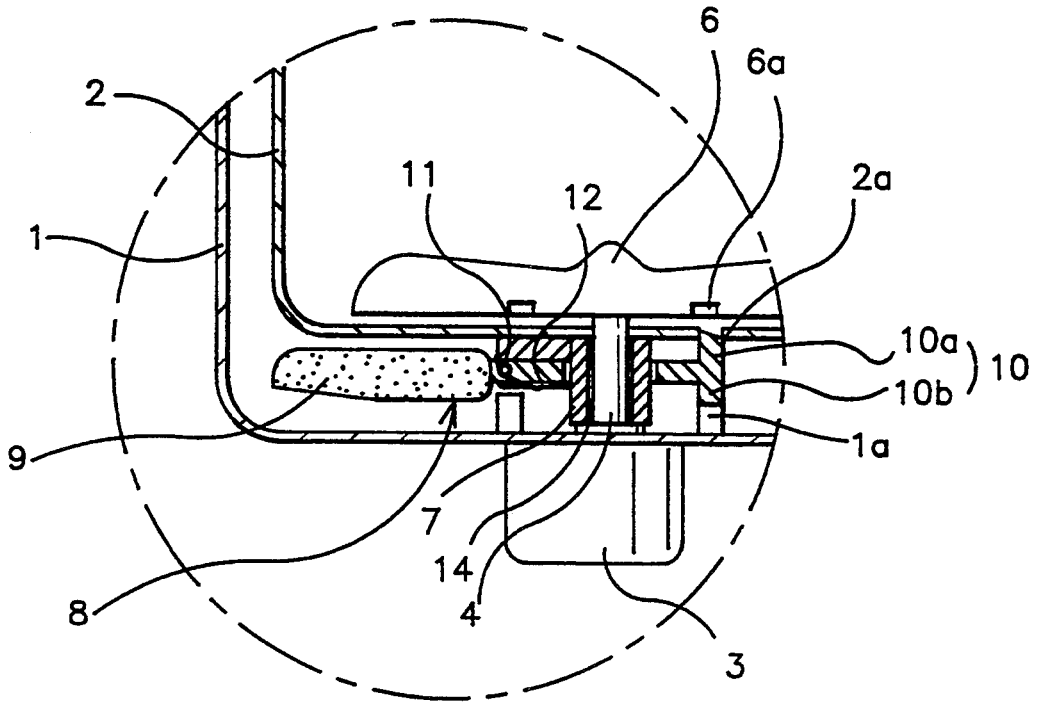
Figure 4B:
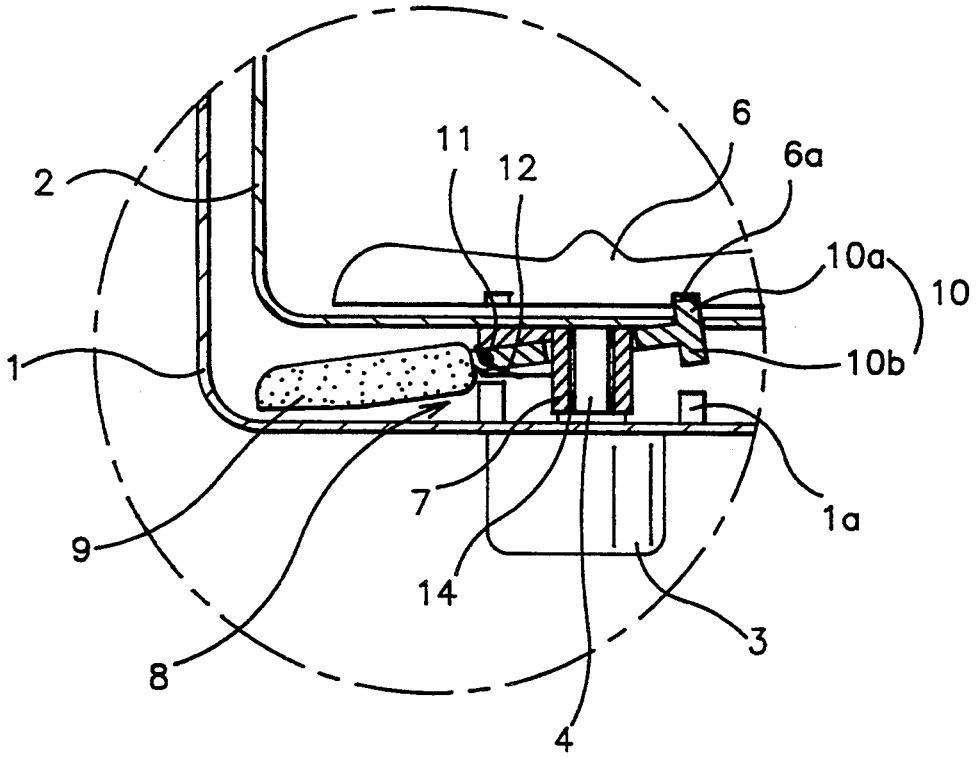

FIG. 3 is a schematic sectional view of an automatic washing machine in accordance with a primary embodiment of the present invention, and FIGS. 4*a* and 4*b* are partially enlarged sectional views of the washing machine in a washing mode and in a dehydrating mode, respectively.

As shown in these drawings, the washing machine includes an outer tub 1 which is supported by a support bar in a cabinet or in a housing. This outer tub 1 has first teeth 1*a* on its inner bottom at a position corresponding to a moving tooth 10, the tooth 10 being described in detail later herein.

A washing and dehydrating tub or an inner tub 2 is rotatably placed in the outer tub 1. This inner tub 2 has a plurality of perforations (not shown) on its side wall and a through hole 2*a* on its bottom.

In addition, a drive motor 3 is provided on an outer bottom of the outer tub 1. In this case, this drive motor 3 is included in an end bracket 3*a* and mounted on the outer bottom of the outer tub 1 such as by a screw with interposition of an outer tub support plate 5 between the bracket 3*a* and the outer bottom of the outer tub 1.

The output shaft 4 of the drive motor 3 rotatably penetrates the bottom centers of the outer and inner tubs 1 and 2. This output shaft 4 of the motor 3 is fixedly coupled to a rotator 6 or a pulsator at its distal end on the inner bottom of the inner tub 2. This rotator 6 is provided with second teeth 6a on its lower surface at a position corresponding to the through hole 2a of the inner tub 2.

The washing machine of this invention also includes a sealer 13 which is provided between the upper surface of the end bracket 3a and the lower surface of the outer tub 1 for prevention of washing water leakage.

Since the drive motor 3 is mounted on the outer bottom center of the outer tub 1 as described above, the drive motor 3 and the shaft 4 are assembled to the tubs 1 and 2 at the same time and the desired center of gravity of the washing machine is achieved, so that the structural stability of the washing machine is achieved. In this regard, operational noise and operational vibration of the washing machine are remarkably reduced. This type of washing machine is conventionally referred to as direct driving type.

However, it should be noted that the present invention is not limited to the above washing machine of the direct driving type but may be applied to a washing machine of the indirect driving type in which the drive motor is mounted on the outer bottom of the outer tub at a position radially spaced apart from the bottom center and indirectly transmits its rotational force to the washing shaft through a V-belt. The indirect driving type washing machine to which the present invention is adapted will be described below.

In the primary embodiment shown in the drawings, the washing machine is a pulsator type machine having the pulsator as the rotator 6. However, the present invention may be applied to a washing machine of the agitator type having an agitator as the rotator 6.

In the washing machine of the present invention, the output shaft 4 of the drive motor 3 penetrates the bottom center of the inner tub 2, and a housing 7 is fixedly mounted on the outer bottom of the inner tub 2 such as by bolts.

Here, the housing 7 has a center part which surrounds the output shaft 4 of the drive motor 3 and is longer than the other parts of the housing 7, thus to cause the output shaft 4 of the drive motor 3 to stably penetrate the bottom center of the inner tub 2 and to guide a smooth rotation of this shaft 4.

The housing 7 is provided with at least one sliding member, such as a sliding bearing or a bush, at its center part through which the output shaft 4 of the drive motor 3 penetrates the bottom center of the inner tub 2, thereby achieving the smooth rotation of the output shaft 4.

Turning to FIGS. 4a and 4b, a lever 8, having a floating member 9 at one end thereof and a moving tooth 10 at the other end thereof, is hinged to the housing 7 by a connection pin 11 inserted in pin holes (not shown) formed in both the lever 8 and the housing 7, such that this lever 8 is seesawed about the connection pin 11.

Because the above hinged connection of the lever 8 to the housing 7, the floating member 9 mounted on the one end of the lever 8 is lowered when no washing water is present in the outer tub 1 such as when the washing machine is not used or in the dehydrating mode, so that the moving tooth 10 of the lever 8 is lifted, as shown in FIG. 4b, in order to be received by the second teeth 6a of the rotator 6 after passing through the through hole 2a of the inner tub 2, thus to engage the inner tub 2 with the rotator 6.

That is, the inner tub 2 is engaged with the rotator 6.

In this case, if the rotator 6 is rotated by the driving of a motor, the inner tub 2 is also rotated, thereby enabling the dehydrating to be performed.

On the contrary, in the case of washing water contained in the outer tub 1, the floating member 9 of the lever 8 is floated on the washing water due to buoyancy of the water, so that it is lifted while lowering the moving tooth 10. In this regard, the moving tooth 10 of the lever 8 is separated from the second teeth 6a of the rotator 6 but engaged with the first teeth 1a of the outer tub 1, thereby engaging the inner tub 2 with the outer tub 1 instead of the rotator 6.

Accordingly, if the engagement between the inner tub 2 and the rotator 6 is released, the inner tub 2 is engaged with the outer tub 1.

In this case, if the rotator 6 is rotated by the driving of motor, the rotator 6 is only rotated alone.

In accordance with the present invention, the floating member 9 is connected to elastic return means 12, such as a torsion spring, such that it is automatically lowered by the restoring force of the elastic return means 12 when the washing water is drained from the outer tub 1 and, as a result, it is not influenced by the buoyancy of the water. In this case, the lever 8 is seesawed about the connection pin 11 in order to lift the moving tooth 10 as described above.

In the present invention, the elastic return means 12 should have an elasticity smaller than the buoyancy of the water in order to cause the floating member 9 to be reliably floated on the water when there is the washing water in the outer tub 1. As a result of the elastic return means 12, the floating member 9 is reliably automatically lowered when the washing water is drained from the outer tub 1.

In accordance with the present invention, the floating member 9 may have a variety of floatable shapes, such as an air bag shape, and be made of various floatable materials, such as styrofoam.

In order to selectively engage the inner tub 2 with the rotator 6 or with the outer tub 1, the washing machine of this invention includes the first teeth 1a provided on the inner bottom of the outer tub 1, the second teeth 6a provided on the lower surface of the rotator 6, the through hole 2a provided on the bottom of the inner tub 2 and the moving tooth 10 provided on the other end of the lever 8, as described above.

In the primary embodiment of this invention shown in the drawings, the first teeth 1a and second teeth 6a comprise gears which are annularly toothed on the inner bottom of the outer tub 1 and on the lower surface of the rotator 6 about the center of the motor shaft 4, respectively. The moving tooth 10 of the lever 8 comprises an upper section 10a and a lower section 10b which are to be engaged with the second teeth 6a and the first teeth 1a, respectively.

It is preferred to form the tops of the teeth 1a, 6a and 10 in a rounded shape such that they are smoothly engaged with each other.

When the washing water is contained in the outer tub 1, the floating member 9 is floated on the water while the moving tooth 10 is lowered, so that the lower section 10b is engaged with the first teeth 1a in order to engage the inner tub 2 with the outer tub 1. On the contrary, when the washing water is drained from the outer tub 1, the floating member 9 is elastically lowered by both its own weight and the restoring force of the elastic return means 12 while the moving tooth 10 is lifted, so that the upper section 10a is engaged with the second teeth 6a in order to engage the inner tub 2 with the rotator 6.

When the upper section 10a of the moving tooth 10 is engaged with the second teeth 6a of the rotator 6 in order to engage the inner tub 2 with the rotator 6, it passes through the through hole 2a of the inner tub 2. In this state, the inner tub 2 and the rotator 6 are rotated at the same time as a result of transmission of the rotational force of the drive motor 3 to the rotator 6 through the output shaft 4.

Meanwhile, the lower section 10b of the moving tooth 10 is engaged with the first teeth 1a of the outer tub 1 in order to engage the inner tub 2 with the outer tub 1. In this state, only the rotator 6 is rotated by the rotational force of the drive motor 3 transmitted thereto through the output shaft 4.

The operational effect of the above washing machine will be described in detail in conjunction with FIGS. 4a and 4b.

When no washing water is present in the outer tub 1, the floating member 9 of the lever 8 is lowered while the moving tooth 10 is lifted as shown in FIG. 4b. In this case, the lower section 10b of the moving tooth 10 is separated from the first teeth 1a of the outer tub 1, however, the upper section 10a of the moving tooth 10 passes through the through hole 2a of the inner tub 2 and is engaged with the second teeth 6a of the rotator 6.

Upon selection of the washing mode and pushing of a start button, a water supply valve (not shown) is opened in order to supply the washing water into the outer tub 1, and the drive motor 3 is rotated at a lower speed.

As the washing water is supplied to the outer tub 1 as described above, the floating member 9 of the lever 8 is floated on the water surface by the buoyancy of the water and levers the lever 8 clockwise about the connection pin 11 as shown at the arrow of FIG. 4b, thus to achieve its predetermined floated position as shown in FIG. 4a.

Thus, the upper section 10a of the moving tooth 10 is separated from the second teeth 6a of the rotator 6 while the lower section 10b is engaged with the first teeth 1a of the outer tub 1, so that the inner tub 2 is engaged with the outer tub 1 instead of the rotator 6 by the moving tooth 10. In this state, the rotational force of the drive motor 3 is transmitted to the rotator 6 through the output shaft 4, thus to rotate only the rotator 6. Since only the rotator 6 is rotated as described above, the washing machine is operated in the desired washing mode.

In this washing mode, the inner tub 2 is applied with a rotational force caused by both the friction between the washing water and the laundry and the water current, so that it tends to be rotated. However, in accordance with the present invention, the inner tub 2 is reliably prevented from rotation since it is engaged with the stationary outer tub 1 by the moving tooth 10.

Upon starting the dehydrating mode of the washing machine after the above washing mode, a drain valve (not shown) provided on the lower section of the outer tub 1 is opened in order to drain the washing water from the outer tub 1.

As the washing water is drained from the outer tub 1, the floating member 9 is lowered by both its own weight and the restoring force of the elastic return means 12 and levers the lever 8 counterclockwise about the connection pin 11, thus to achieve its lowered position as shown in FIG. 4b.

Hence, the lower section 10b of the moving tooth 10 is separated from the first teeth 1a of the outer tub 1 while the upper section 10a of the moving tooth 10 is engaged with the second teeth 6a of the rotator 6 through the through hole 2a of the inner tub 2. Here, the lever 8 is hinged to the housing 7 by the connection pin 11 and also engaged with the rotator 6 by the moving tooth 10, and the housing 7 is fixed to the outer bottom of the inner tub 2, so that the inner tub 2 is engaged with the rotator 6. In this state, the rotational force of the drive motor 3 is transmitted to the rotator 6 through the output shaft 4, thus to rotate the rotator 6 together with the inner tub 2 engaged with the rotator 6. Since both the rotator 6 and the inner tub 2 are rotated at a high speed as described above, the washing machine is operated in the desired dehydrating mode.

Figure 5:
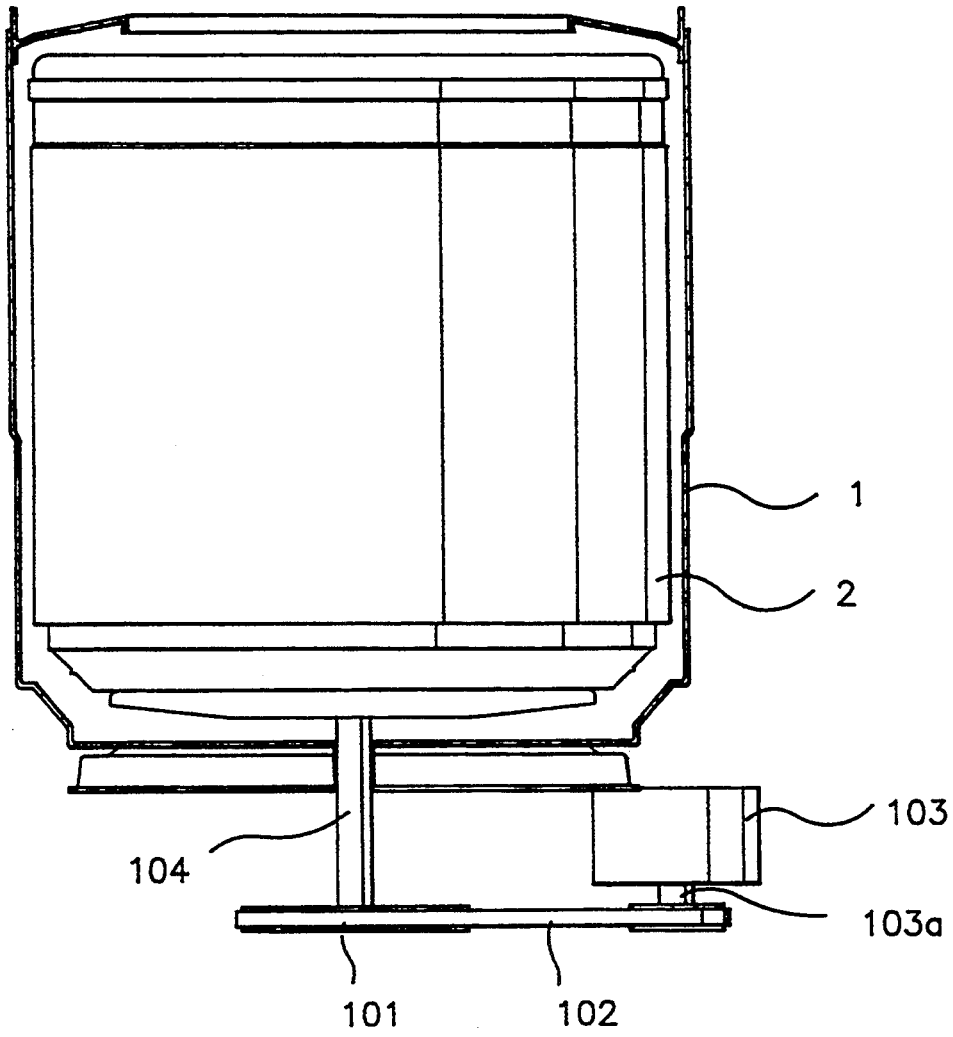
FIG. 5 is a schematic view of an automatic washing machine in accordance with a second alternate embodiment of the present invention.

Turning to FIG. 5, there is shown an automatic washing machine in accordance with a second alternate embodiment of the present invention. In this embodiment, the general shape and the operational effect of means for selectively engaging the inner tub with the rotator or with the outer tub remain the same as described for the primary embodiment, but the location of the drive motor is changed such that the rotational force of the drive motor is indirectly transmitted to the washing shaft. That is, the drive motor 103 is not mounted on the outer bottom center of the outer tub but mounted on the outer bottom of the outer tub 1 at a position spaced apart from the bottom center and indirectly transmits its rotational force to a washing shaft 104 through a transmission belt 102 wrapped about an output shaft 103a of the motor 103 and a pulley 101 of the washing shaft 104. Here, the washing shaft 104 is provided with the rotator 6 on its top end. In other words, in this embodiment, the present invention is adapted to a washing machine of the indirect driving type.

When the present invention is adapted to the indirect driving type washing machine as shown in FIG. 5, the structural stability of the washing machine is somewhat deteriorated since a desired balance of the washing machine may be not achieved due to the drive motor radially spaced apart from the bottom center of the outer tub. However, this second alternate embodiment may improve the power transmission ratio between the motor shaft 103a and the washing shaft 104, thus to allow a drive motor of a relatively lower capacity to be used as the motor 103.

As described above, an automatic washing machine in accordance with the present invention selectively transmits the rotational force of a drive motor, which is always transmitted to a rotator, to a washing and dehydrating tub, otherwise stated, an inner tub, in accordance with a fluctuating movement of a floating member provided between the bottoms of an outer tub and the inner tub, thus to achieve a desired dehydrating operation without using a conventional complex clutch assembly. In this regard, this washing machine simplifies its construction, so as to be easily fabricated and reduced in the manufacturing cost. The simple construction of the washing machine also minimizes problems and improves the reliability of the washing machine. In accordance with an embodiment of the present invention, the drive motor is mounted on the outer bottom center of the outer tub, so that a desired center of gravity of the washing machine is achieved and this structurally stabilizes the washing machine and remarkably reduces the operational noise as well as the operational vibration of the washing machine.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An automatic washing machine comprising:

an outer tub for containing washing water therein, said outer tub having first teeth on its inner bottom;

an inner tub for washing and dehydration placed in said outer tub, said inner tub having a plurality of perforations on its side wall and a through hole on its bottom at a position corresponding to said first teeth of the outer tub;

a motor mounted on an outer bottom center of said outer tub, said motor having an output shaft rotatably penetrating bottom centers of said outer and inner tubs;

means for generating a water current using the rotational force of said motor, said water current generating means being mounted on a top end of said output shaft and having second teeth on its lower surface at a position corresponding to said through hole of the inner tub; and means for selectively engaging said inner tub with said water current generating means or with said outer tub, said selective engaging means being mounted between bottoms of said inner and outer tubs and having a floating member, the selective engagement of said inner tub with said water current generating means or with said outer tub being achieved in accordance with a fluctuating movement of said floating member caused by buoyancy of said washing water in the outer tub.

2. The automatic washing machine as claimed in claim 1, wherein said selective engaging means comprises:

a lever having said floating member at one end thereof and hinged to an outer bottom of said inner tub at its middle section, thus to be seesawed in accordance with the fluctuating movement of said floating member; and a moving tooth provided on the other end of said lever and having an upper protrusion extending toward said second teeth and a lower protrusion extending toward said first teeth, said upper protrusion in a dehydrating mode passing through said through hole to be engaged with said second teeth as said floating member is lowered and said moving tooth is lifted, thus to engage said inner tub with said water current generating means, however, in a washing mode, said upper protrusion being separated from said second teeth but still engaged with said through hole, and said lower protrusion being engaged with said first teeth as said floating member is lifted and said moving tooth is lowered, thus to engage said inner tub with said outer tub.

3. The automatic washing machine as claimed in claim 2, further comprising means for promoting a lowering of said floating member when said buoyancy of the washing water decreases.

4. The automatic washing machine as claimed in claim 2, wherein said first and second teeth are teeth of the gear type.

5. The automatic washing machine as claimed in claim 2, wherein said first and second teeth and said protrusions of the moving tooth are rounded at their tops for promotion of smooth engagement with each other.

6. The automatic washing machine as claimed in claim 1, further comprising a housing provided on an outer bottom of said inner tub for rotatably supporting said output shaft of the motor and pivotally supporting said selective engaging means.

7. The automatic washing machine as claimed in claim 6, wherein said housing includes a bearing member for promoting a rotation of said output shaft of the motor therewithin.

8. The automatic washing machine as claimed in claim 1, further comprising a sealer for prevention of water leakage at a bottom of said outer tub around said output shaft of the motor.

9. An automatic washing machine comprising:

an outer tub for containing washing water therein, said outer tub having first teeth on its inner bottom;

an inner tub for washing and dehydration placed in said outer tub, said inner tub having a plurality of perforations on its side wall and a through hole on its bottom at a position corresponding to said first teeth of the outer tub;

a shaft rotatably penetrating bottom centers of said outer and inner tubs;

a drive motor mounted on an outer bottom of said outer tub such that it is eccentric from said shaft;

means for transmitting a rotational force of said motor to said shaft;

means for generating a water current using the rotational force of said motor, said water current generating means being mounted on a top end of said shaft and having second teeth on its lower surface at a position corresponding to said through hole of the inner tub; and means for selectively engaging said inner tub with said water current generating means or with said outer tub, said selective engaging means being mounted between bottoms of said inner and outer tubs and having a floating member, the selective engagement of said inner tub with said water current generating means or with said outer tub being achieved in accordance with a fluctuating movement of said floating member caused by buoyancy of said washing water in the outer tub.

10. The automatic washing machine as claimed in claim 9, wherein said selective engaging means comprises:

a lever having said floating member at one end thereof and hinged to an outer bottom of said inner tub at its middle section, thus to be seesawed in accordance with the fluctuating movement of said floating member; and a moving tooth provided on the other end of said lever and having an upper protrusion extending toward said second teeth and a lower protrusion extending toward said first teeth, said upper protrusion in a dehydrating mode passing through said through hole to be engaged with said second teeth as said floating member is lowered and said moving tooth is lifted, thus to engage said inner tub with said water current generating means, however, in a washing mode, said upper protrusion being separated from said second teeth but still engaged with said through hole, and said lower protrusion being engaged with said first teeth as said floating member is lifted and said moving tooth is lowered, thus to engage said inner tub with said outer tub.

11. The automatic washing machine as claimed in claim 10, further comprising means for promoting a lowering of said floating member when said buoyancy of the washing water decreases.

12. The automatic washing machine as claimed in claim 10, wherein said first and second teeth and said protrusions of the moving tooth are rounded at their tops for promotion of smooth engagement with each other.

13. The automatic washing machine as claimed in claim 9, further comprising a housing provided on an outer bottom of said inner tub for rotatably supporting said shaft and pivotally supporting said selective engaging means.

14. The automatic washing machine as claimed in claim 13, wherein said housing includes a bearing member for promoting a rotation of said shaft therewithin.

15. The automatic washing machine as claimed in claim 9, further comprising a sealer for prevention of water leakage at a bottom of said outer tub around said shaft.

16. The automatic washing machine as claimed in claim 9, wherein said first and second teeth are teeth of the gear type.

17. The automatic washing machine as claimed in claim 9, wherein said rotational force transmission means comprises:

a first belt pulley fixed to an output shaft of said motor;

a second belt pulley fixed to an end of said shaft such that it corresponds to said first pulley; and an endless belt wrapped about said pulleys for transmission of the rotational force of said motor to said shaft.

* * * * *